US007651317B2

(12) United States Patent
Charier et al.

(10) Patent No.: US 7,651,317 B2
(45) Date of Patent: Jan. 26, 2010

(54) MULTISTAGE TURBOMACHINE COMPRESSOR

(75) Inventors: Gilles Alain Marie Charier, La Grande Paroisse (FR); Franck Christian Conan, Seine Port (FR); Thomas Julien Roland Earith, Veneux les Sablons (FR); Marc Leandri, Boussy St Antoine (FR)

(73) Assignee: SNECMA, Paris (FR)

( * ) Notice: Subject to any disclaimer, the term of this patent is extended or adjusted under 35 U.S.C. 154(b) by 458 days.

(21) Appl. No.: 11/476,113

(22) Filed: Jun. 28, 2006

(65) Prior Publication Data

US 2009/0304498 A1 Dec. 10, 2009

(30) Foreign Application Priority Data

Jun. 29, 2005 (FR) ..... 05 06610

(51) Int. Cl.
*F01D 11/14* (2006.01)

(52) U.S. Cl. ..... 415/173.3; 415/174.2

(58) Field of Classification Search ..... 415/173.2, 415/173.3, 174.1, 173.7, 173.6, 173.4, 174.4, 415/128, 135

See application file for complete search history.

(56) References Cited

U.S. PATENT DOCUMENTS

| | | | | |
|---|---|---|---|---|
| 3,314,648 | A * | 4/1967 | Werner | 415/174.4 |
| 3,511,577 | A * | 5/1970 | Karstensen | 415/173.7 |
| 4,101,242 | A * | 7/1978 | Coplin et al. | 415/134 |
| 4,522,559 | A | 6/1985 | Burge et al. | |
| 5,351,478 | A | 10/1994 | Walker et al. | |
| 5,630,702 | A | 5/1997 | Marmilic et al. | |
| 6,935,836 | B2 * | 8/2005 | Ress, Jr. et al. | 415/173.2 |

FOREIGN PATENT DOCUMENTS

| | | |
|---|---|---|
| FR | 2 688 539 | 9/1993 |

* cited by examiner

*Primary Examiner*—Richard Edgar
(74) *Attorney, Agent, or Firm*—Oblon, Spivak, McClelland, Maier & Neustadt, L.L.P.

(57) ABSTRACT

A multistage compressor for a turbomachine, in particular an airplane turboprop or turbojet, the compressor comprising a double-walled casing having an inner wall made up of shrouds surrounding respective annular rows of moving blades and annular rows of straightening stator vanes, said shrouds being connected to the outer wall of the casing by independent suspension means enabling the radial clearances between the outer ends of the moving blades and the shrouds of the inner wall of the casing to be adjusted independently from one compression stage to another.

11 Claims, 2 Drawing Sheets

MULTISTAGE TURBOMACHINE COMPRESSOR

The invention relates to a multistage turbomachine compressor, in particular a high-pressure compressor, and the invention also relates to an airplane turbojet or turboprop fitted with such a compressor.

BACKGROUND OF THE INVENTION

A high-pressure compressor of a turbojet or a turboprop comprises a plurality of compression stages each comprising an annular row of moving blades of a rotor that rotates inside a stationary casing with the blades being mounted on a shaft of the turbomachine, together with an annular row of stator vanes for straightening the air flow, which vanes are carried by the casing via their radially-outer ends.

It is very important for the radial clearances between the moving blades and the casing to be optimized in order to improve the efficiency of the compressor and of the turbomachine, and in order to avoid friction between the ends of the moving blades against the casing which leads to said ends becoming worn and to permanent reduction in the efficiency of the turbomachine at all operating speeds.

Optimizing radial clearances is a problem that is very complex since these clearances depend on different parameters such as operating temperature, which varies from one compression stage to another, speed of rotation of the compressor, and speeds of radial vibration in the stator and the rotor, which speeds are different and also vary from one compression stage to another, because of the different weights and radial dimensions of the moving blades in the various stages.

In order to provide a partial solution to this problem, proposals have already been made to use a double-walled casing comprising a stationary outer wall and an inner wall that is capable of moving radially and that is connected to the outer wall by suspension means that are flexible or deformable, and referred to as "hairpins".

By calculation, it is possible to determine the radial vibration speeds of the casing and of the rotor at different speeds of operation, and thereafter the shapes, the weights, and the stiffnesses of the hairpins are determined so that the vibrational behavior of the inner wall of the casing is adapted as well as possible to the vibrational behavior of the rotor. By injecting air into the casing, it is also possible to ventilate the hairpins so as to modify their thermal expansion and thereby adjust the radial clearances between the inner wall of the casing and the ends of the moving blades of the various compression stages.

Nevertheless, in the prior art, the compression stages are secured to one another, at least in groups of two, via the inner wall of the casing, which limits the possibilities for adjusting radial clearances because these clearances are adjusted in the same way for the compression stages are connected together, even though the variations in these clearances differ from one stage to another.

OBJECTS AND SUMMARY OF THE INVENTION

A particular object of the present invention is to provide a solution to this problem that is simple, effective, and inexpensive.

The invention provides a multistage turbomachine compressor, in particular a high-pressure compressor, in which it is possible to adjust the radial clearances of the various stages, or at least of some of the various stages, in independent manner for each stage.

To this end, the invention provides a multistage turbomachine compressor comprising annular rows of moving blades rotating inside a double-walled casing, and annular rows of straightening stator vanes carried by an inner wall of the double-walled casing, wherein the inner wall of the casing comprises a plurality of shrouds substantially in end-to-end alignment and suspended independently of one another from the outer wall of the casing, some of the shrouds each surrounding an annular row of moving blades and other shrouds each carrying an annular row of straightening stator vanes.

In the compressor of the invention, all, or at least some of the various compression stages are thus separate from one another, thereby making it possible to adjust the radial clearances of these stages independently for each stage, taking account of differences between stages in their weights, their radial dimensions, and their operating temperatures. This results in an improvement in the efficiency of the compressor and in the operability of the turbomachine.

It is thus possible in a compressor of the invention for each annular row of moving blades to be surrounded by a shroud suspended from the outer wall of the casing in a manner that is independent from the other shrouds surrounding the other annular rows of moving blades.

It is also possible to interconnect two shrouds of the inner wall of the casing that surround two successive annular rows of moving blades, providing the moving blades have the same dimensions in both annular rows.

Under such circumstances, the vibrational behavior of the blades in both compression stages is not modified by differences in the weights and the radial dimensions of the moving blades, and it is then acceptable for two similar compression stages to be secured to each other.

According to a characteristic of the invention, the shrouds are suspended from the outer wall of the casing by means that are flexible or deformable.

According to another characteristic of the invention, a first shroud surrounding an annular row of moving blades is adjacent to a second shroud carrying an annular row of straightening stator vanes, an axial end of said second shroud being connected to the first shroud via means that provide sealing against the flow of gas passing through the compressor.

This ensures continuity of the flow of gas flowing through the compressor.

According to another characteristic of the invention, the axial second end of the second shroud is connected to a third shroud surrounding another row of moving blades via means that provide sealing against the flow of gas passing through the compressor.

This ensures continuity for the flow of gas passing through the compressor by preventing gas from escaping into the space lying between the two walls of the casing, while nevertheless allowing the first and third shrouds to be suspended independently so as to enable the radial clearances in these two compression stages to be adjusted independently.

The axial second end of the second shroud can then be connected to the outer wall of the casing by the means for suspending the third shroud.

In a possible variant embodiment, the axial second end of the second shroud is spaced apart axially from a third shroud surrounding another annular row of moving blades and is connected by its own suspension means to the outer wall of the casing.

Under such circumstances, annular clearance axially separating the second shroud from the third shroud constitutes a passage allowing air to penetrate into a cavity that is formed in the casing between the suspension means for the second shroud and the suspension means for the third shroud, and into which there open out air takeoff means carried by the outer wall of the casing, these air takeoff means being connected to other equipments of the turbomachine.

This ensures that the air leaving the compressor via said axial annular clearance does not accumulate between the two walls of the casing where it would create a dead zone of uncontrollable temperature, to the detriment of accurate adjustment of the radial clearances of the adjacent compression stages.

In general, the invention makes it possible for the radial modes of vibration of the shrouds surrounding the annular rows of moving blades in the compressor to be adjusted independently from one shroud to another, i.e. from one stage to another, so as to optimize the radial clearances between said shrouds and the annular rows of moving blades that rotate inside the shrouds.

In practice, efforts are made to ensure that these radial clearances are as small as possible under normal operating speeds, e.g. corresponding to cruising speed, while other operating speeds are characterized by radial clearances that are greater, while nevertheless remaining acceptable.

The invention also provides an airplane turbojet or turboprop that includes a high-pressure compressor as described above.

BRIEF DESCRIPTION OF THE DRAWINGS

The invention can be better understood and other characteristics, details, and advantages thereof appear more clearly on reading the following description made by way of example and with reference to the accompanying drawings, in which.

MORE DETAILED DESCRIPTION

Figure 1:
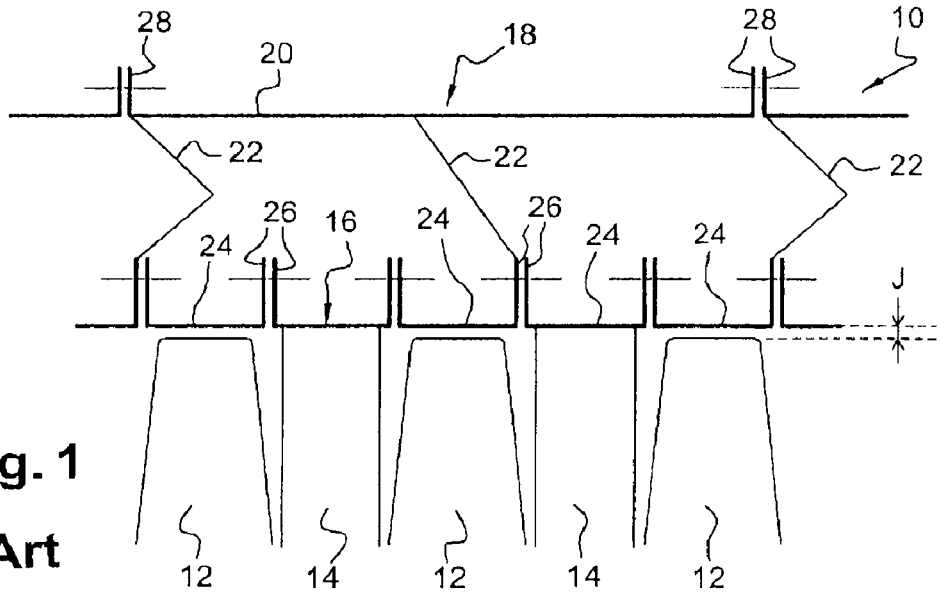
Fig. 1 Prior Art
FIG. 1 is a highly diagrammatic axial section view of a portion of a high-pressure compressor of a prior art turbomachine.

The compressor 10 of FIG. 1, which shows the prior art, comprises a certain number of compression stages, of which only three are shown, each stage comprising an annular row of moving blades 12, whose radially-inner ends are secured to a disk carried by a shaft of the turbomachine, and an annular row of straightening stator vanes 14 disposed downstream from the annular row of moving blades 12 and having their radially-outer ends carried by a radially-inner wall 16 of a double-walled cylindrical casing 18.

The inner cylindrical wall 16 of the casing 18 is suspended from the outer cylindrical wall 20 of said casing by flexible or deformable means 22 sometimes referred to as "hairpins" in the art, and it is known how to vary the shapes, the weights, and the stiffness thereof in such a manner that the inner wall 16 of the casing follows as closely as possible the radial vibration of the rotor having the annular rows of moving blades 12.

In that prior art, the inner cylindrical wall 16 of the casing is made up of shrouds 24 on a common axis, which shrouds are in end-to-end alignment and rigidly connected to one another via annular flanges 26 projecting radially outwards and secured to one another by suitable means such as bolts.

Like the inner wall 16, the outer wall 20 of the casing 18 can be made up of shrouds arranged end to end and rigidly secured to one another by outwardly-directed annular flanges 28 using bolts or the like.

The suspension hairpins 22 which connect the outer wall 20 of the casing to the annular flanges 26 of the shrouds 24 of the inner wall 16 enable the radial clearance J between the shrouds 24 and the radially-outer ends of the moving blades 12 to be adjusted, but this adjustment is the same for all three compression stages shown in the drawing even though these radial clearances vary in different manner from one stage to another at the different operating speeds of the turbomachine.

Figure 2:
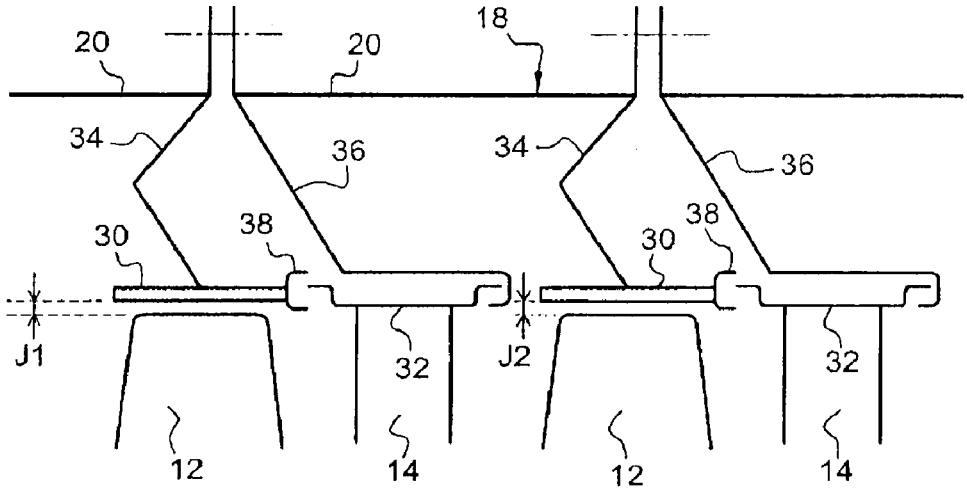
FIG. 2 is a highly diagrammatic axial section view of a portion of a high-pressure compressor of the invention.

In the compressor of the invention, and as can be seen in the embodiment of FIG. 2, these radial clearances can be adjusted independently from one compression stage to another because the shrouds constituting the inner wall of the casing and surrounding the annular rows of moving blades are suspended independently of one another from the outer wall of the casing, either for all of the compression stages of the compressor, or at least for a majority of them.

In FIG. 2 where two compression stages of the compressor of the invention are shown diagrammatically, the inner wall of the casing 18 is formed by a succession of respective pairs of shrouds 30, 32, each shroud being suspended from the outer wall 20 of the casing independently of the others via respective hairpins 34, 36, each shroud 30 surrounding an annular row of moving blades 12, and each shroud 32 carrying an annular row of straightening stator vanes 14.

In each compression stage, the shroud 30 is connected to the shroud 32 situated downstream therefrom by means 38 that provide annular sealing between these two shrouds relative to the flow of gas passing through the compressor, thus ensuring continuity of said flow of gas through the compressor and avoiding air entering into the space between the inner and outer walls of the casing 18.

The independent suspensions of the various shrouds 30, 32 of the inner wall of the casing make it possible to adjust independently of one another the radial clearances J1 and J2 between the radially-outer ends of the moving blades 12 and the shrouds 30 in each compression stage. Typically, the order of magnitude of these radial clearances is one-tenth of a millimeter, while the number of compression stages in a high-pressure compressor may lie in the range about 5 to about 10, depending on the engine.

Figure 3:
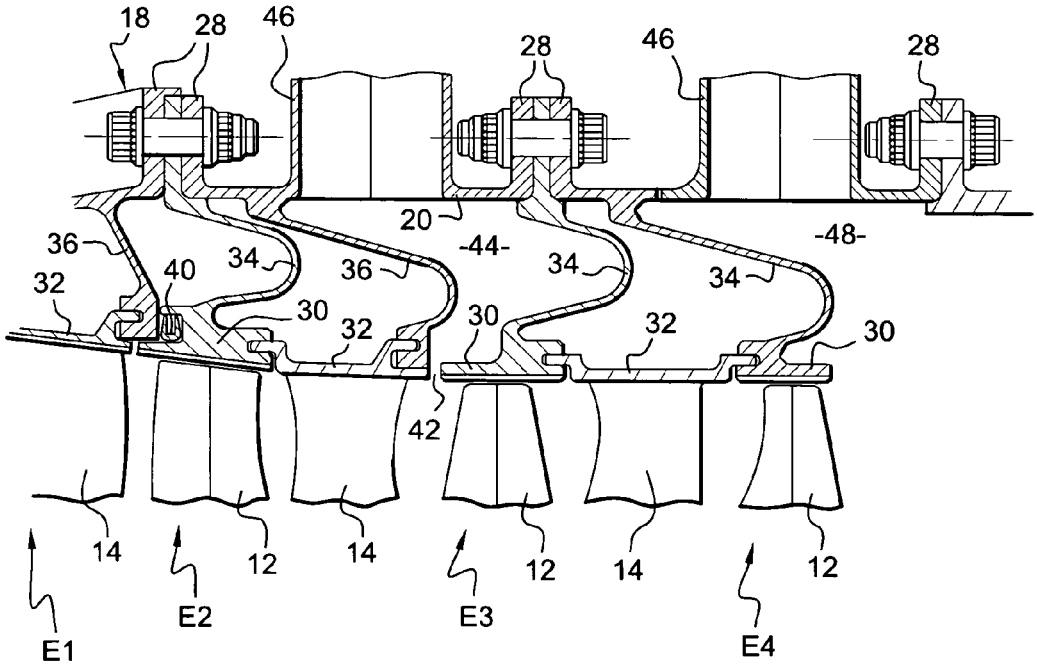
FIG. 3 is another diagrammatic axial section view of a portion of a compressor of the invention.

In FIG. 3, which is more detailed than FIG. 2, there can be seen a shroud 32 of the inner wall of the casing 18 carrying an annular row of straightening stator vanes 14 of a compression stage E1, and connected to the outer wall of the casing by suspension means 36, while co-operating at its downstream end with the upstream end of a shroud 30 of the following compression stage E2, via sealing means 40 of annular shape which are mounted, for example, in an upstream end groove of the shroud 30 of the stage E2 and which are pressed against the downstream end of the shroud 32 of the stage E1 or against a radial annular face of the suspension means 36 of said shroud 32.

The shroud 30 of the compression stage E2 which surrounds the annular row of moving blades 12 of said stage is connected at its downstream end to a shroud 32 that carries an annular row of straightening stator vanes 14 of said stage and whose downstream end is connected via suspension means 36 to the outer wall of the casing 18.

The shroud 32 of the compression stage E2 is separated from the shroud 30 of the following compression stage E3 by axial annular clearance 42 that forms a passage for gas between the inside of the compressor and a cavity 44 defined in the casing 18 between the inner and outer walls thereof and also between the means 36 for suspending the shroud 32 of the preceding stage E2 and the means 34 for suspending the shroud 30 of the stage E3.

One or more air takeoffs 46 are formed in the outer wall of the casing 18 and open out into said cavity 44 in order to feed air to equipments of the turbomachine.

The downstream end of the shroud 30 of the compression stage E3 is connected in sealed manner to the upstream end of a shroud 32 carrying the straightening stator vanes 14 of said compression stage. The downstream end of this shroud 32 is connected in sealed manner, e.g. by mutual interfitting, to the upstream end of the shroud 30 of the following compression stage E4 which is connected by its suspension means 34 to the outer wall of the casing 18. The shroud 32 of the compression stage E3 is thus carried by the shroud 30 of said compression stage and by the shroud 30 of the following compression stage E4.

Another air takeoff 46 may be formed in the outer wall of the casing 18 so as to open out into a cavity 48 formed between the inner and outer walls of the casing downstream from the means 34 for suspending the shroud 30 of the stage E4.

It can be seen that the radial clearances of the compression stage E2 can be adjusted independently of the radial clearances of the compression stage E1 and of the following compression stages E3 and E4, while the radial clearances of the compression stages E3 and E4 are adjusted in a manner that is not independent, the moving blades 12 of these two stages having the same radial dimensions, with the shrouds 30 of the stages E3 and E4 being secured to each other by means of the shrouds 32 of the stage E3.

What is claimed is:

1. A multistage turbomachine compressor comprising annular rows of moving blades rotating inside a double-walled casing, and annular rows of straightening stator vanes carried by an inner wall of the double-walled casing, wherein the inner wall of the casing comprises a plurality of shrouds substantially in end-to-end alignment and suspended independently of one another from the outer wall of the casing by suspension members that are flexible or deformable, some of the shrouds each surrounding an annular row of moving blades and other shrouds each carrying an annular row of straightening stator vanes, said suspension members having a substantially C-shape cross section and being configured to adjust the radial clearances between radially outer-ends of the moving blades and the corresponding shrouds independently of one another.

2. A compressor according to claim 1, wherein each annular row of moving blades is surrounded by a shroud suspended from the outer wall of the casing independently from the other shrouds surrounding the other annular rows of moving blades.

3. A compressor according to claim 1, wherein two shrouds of the inner wall of the casing, surrounding two successive annular rows of moving blades are securely connected together, the moving blades of these two successive rows having the same dimensions.

4. A compressor according to claim 3, wherein a shroud carrying an annular row of straightening stator vanes situated between the two shrouds surrounding annular rows of moving blades is carried by said two shrouds and is securely connects them together.

5. A compressor according to claim 1, wherein at least one of the shrouds surrounding an annular row of moving blades is adjacent to a second shroud carrying an annular row of straightening stator vanes and is connected in gastight manner to said second shroud.

6. A compressor according to claim 5, wherein the second shroud is connected to a third shroud surrounding an annular row of moving blades by means for providing sealing against the flow of gas passing through the compressor.

7. A compressor according to claim 6, wherein the second shroud is connected to the outer wall of the casing by means for suspending said second shroud which are independent of the suspension means for suspending the other shrouds.

8. A compressor according to claim 5, wherein the second shroud is axially spaced apart from a third shroud surrounding an annular row of moving blades and is connected by means for suspending said second shroud to the outer wall of the casing.

9. A compressor according to claim 8, wherein annular clearance axially separating the second shroud and the third shroud constitutes a passage allowing air to penetrate into a cavity that is formed in the casing between the means for suspending the second shroud and the means for suspending the third shroud, and into which there open out means for taking off air, which are carried by the outer wall of the casing.

10. A compressor according to claim 1, wherein the radial modes of vibration of at least some of the shrouds surrounding the annular rows of moving blades are adjusted independently from one shroud to another, in order to optimize the radial clearances between said shrouds and the annular rows of moving blades rotating inside said shrouds.

11. An airplane turbojet or turboprop, including a compressor of the type defined in claim 1.

* * * * *

UNITED STATES PATENT AND TRADEMARK OFFICE

CERTIFICATE OF CORRECTION

PATENT NO. : 7,651,317 B2
APPLICATION NO. : 11/476113
DATED : January 26, 2010
INVENTOR(S) : Gilles Alain Charier et al.

It is certified that error appears in the above-identified patent and that said Letters Patent is hereby corrected as shown below:

Column 6, line 26, delete "suspension".

Signed and Sealed this

Twentieth Day of April, 2010

David J. Kappos

David J. Kappos
*Director of the United States Patent and Trademark Office*